US005832665A

United States Patent [19]

Miller et al.

[11] Patent Number: 5,832,665

[45] Date of Patent: Nov. 10, 1998

[54] SENSING EDGE

[75] Inventors: Bearge D. Miller, Concordville; Karen Sarkissian; Gevork Sarkisian, both of Krum Lynne, all of Pa.

[73] Assignee: Miller Edge, Inc., Concordville, Pa.

[21] Appl. No.: 639,397

[22] Filed: Apr. 29, 1996

[51] Int. Cl.[6] ..... E05F 15/02

[52] U.S. Cl. ..... 49/27; 160/8

[58] Field of Search ..... 49/26, 27, 28; 200/61.43; 160/8, 9; 156/293, 391; 269/488; 428/99, 100; 24/456; 138/115

[56] References Cited

U.S. PATENT DOCUMENTS

| | | |
|---|---|---|
| 2,843,690 | 7/1958 | Miller . |
| 3,315,050 | 4/1967 | Miller . |
| 3,732,384 | 5/1973 | Fischel . |
| 4,051,336 | 9/1977 | Miller . |
| 4,080,519 | 3/1978 | Michalson . |
| 4,273,974 | 6/1981 | Miller . |
| 4,487,648 | 12/1984 | Miller . |
| 4,972,054 | 11/1990 | Miller et al. . |
| 5,087,799 | 2/1992 | Pariot et al. . |
| 5,148,911 | 9/1992 | Miller et al. . |
| 5,418,342 | 5/1995 | Miller . |

*Primary Examiner*—Daniel P. Stodola
*Assistant Examiner*—Curtis Cohen
*Attorney, Agent, or Firm*—Panitch Schwarze Jacobs & Nadel, P.C.

[57] ABSTRACT

A sensing edge is provided for causing a door to open by actuating a device upon force being applied to the sensing edge. The sensing edge includes an elongate outer sheath with a first strip of resiliently compressible material affixed to one of the inner surfaces. A first strip of flexible, electrically conductive material is affixed to the strip of resiliently compressible material. A second strip of flexible, electrically conductive material is supported on the opposite inner surface of the outer sheath. The second strip of conductive material faces the first strip of conductive material, with a space being provided between the first and second strips. The first and second strips of conductive material form a sensor for detection of an external force applied to the sheath, whereby the first strip of resiliently compressible material is adapted to allow displacement of the first strip of flexible, electrically conductive material when the outer sheath is folded for shipping to prevent cracking of the first strip of flexible, electrically conductive material. An L-shaped conduit which is pivotally installed in the upper surface of the outer sheath is also provided, to allow the same sensing edge to be used in left hand or right hand applications.

10 Claims, 4 Drawing Sheets

SENSING EDGE

FIELD OF THE INVENTION

The present invention relates to a sensing edge for a door, and more particularly, to a sensing edge for a door which protects persons, equipment and the door from impact damage and which can be folded for shipping.

BACKGROUND OF THE INVENTION

The use of force-sensing switches or sensing edges attached along the leading edges of doors is generally known in the art. Such sensing edges generally include an outer sheath in which an elongate force-sensing switch is positioned. Upon the application of a force to the sheath, the force-sensing switch actuates suitable control circuitry for controlling the movement of the door generally stopping and/or reversing the closing movement of the door. Generally, the force-sensing switch positioned within the sheath comprises a pair of flexible, electrically conductive sheets positioned on upper and lower sides of a layer of non-conducting foam having a plurality of openings extending therethrough from the upper side to the lower side. The sheets are maintained in position by outer layers of foam located within the sheath such that a positive stack-up comprising a first foam layer, a first conductive sheet, a second foam layer with perforations, a second conductive sheet and a third foam layer, exists between the inner walls of the sheath. Upon the application of an external force to the sheath, the sheets are deflected through the openings in the foam into electrically conductive engagement with each other to thereby actuate the control circuitry for controlling the movement of the door.

Another type of force-sensing switch which can be positioned within the sheath is a pressure sensitive switch. The known pressure sensitive switches typically consist of an elongate tubular member, one end of which is sealingly closed. The other end of the tubular member is in fluid communication with a pressure sensitive transducer. The tubular member is longitudinally positioned within the sheath such that upon application of a force to the sheath, pressure within the tubular member is increased, activating the pressure sensitive transducer which signals suitable control circuitry for controlling the movement of the door.

Sensing edges of this type are typically 10 to 30 feet long and are used along the leading edge of a door. In some applications, such as aircraft hangars, the length of the sensing edge may be longer. Typically, such sensing edges are made of a flexible material and are shipped in a folded or rolled up state to reduce shipping cost. In sensing edges where electrically conductive strips are used to form the sensing element, folding or rolling the sensing edge does not create any problem when the electrically conductive strips are fully supported by foam extending between the electrically conductive sheets and the outer sheath. However, if the electrically conductive sheets are attached directly to opposing inner surfaces of the outer sheath, without any underlying foam supporting material, when the sensing edge is rolled or folded for shipping, the electrically conductive material is often creased and is therefore more prone to failure due to cracking when the sensing edge is unrolled or unfolded for installation. However, it would be desirable to reduce the cost of sensing edges by reducing the amount of the material located inside the outer sheath which was previously required to hold the electrically conductive material in position and prevent damage caused by folding or bending for shipping purposes.

In the known sensing edges which utilize a pressure sensitive switch as the sensing element, a pressure transducer is often located in one end of the sensing edge and electrical connections are provided to the pressure transducer. Alternatively, a tube extends from an end or one side of the outer sheath and is connected to a remote pressure transducer or pressure actuated switch. However, in the known sensing edges, there is often not enough room to provide an electrical or pneumatic tube connection directly on the end of the sensing edge, and the electrical connection or pneumatic connection is provided on one side of the sensing edge. This causes the sensing edge to have a left hand and right hand side and, depending upon the particular application and the existing door equipment, a "left-handed" or "right-handed" sensing edge must be ordered.

The present invention is a result of observation of the limitations with the presently known sensing edges and efforts to provide a sensing edge which can be universally installed in "left-handed" or "right-handed" applications, and to provide a reduced cost sensing edge when can be rolled or folded for shipping without damaging the electrically conductive strips which form the sensor.

SUMMARY OF THE INVENTION

Briefly stated, the present invention is a sensing edge for causing a door to open by actuating a device upon force being applied to the sensing edge. The door includes a leading edge surface, a first side surface and a second side surface, with the first and second side surfaces being oppositely disposed. The door is movably mounted. The sensing edge comprises an elongate outer sheath having first and second ends, first and second opposing outer surfaces and first and second facing inner surfaces. The first outer surface is adapted for connection to the leading edge of the door. A first strip of resiliently compressible material having a first face and a second face is provided. The first face is adhesively connected to one of the first and the second inner surfaces of the elongate outer sheath. A first strip of flexible, electrically conductive material having a first face and a second face is also provided. The first face of the first strip of flexible, electrically conductive material is affixed to the second face of the first strip of resiliently compressible material. A second strip of flexible, electrically conductive material having a first face and a second face is provided. The first face of the second strip of flexible, electrically conductive material is supported on the other of the first and second inner surfaces of the elongate outer sheath. The second face of the second strip of flexible, electrically conductive material faces the second face of the first strip of flexible, electrically conductive material. An open space is located between the entire second face of the first strip of flexible, electrically conductive material and the second face of the second strip of flexible, electrically conductive material. The first and second strips of flexible, electrically conductive material form a sensor for detection of an external force applied to the sheath, whereby the first strip of resiliently compressible material is adapted to allow displacement of the first strip of flexible, electrically conductive material when the outer sheath is folded for shipping to prevent cracking of the first flexible, electrically conductive contact.

The present invention also provides a sensing edge for causing a door to open by actuating a device upon force being applied to the sensing edge. The door has a leading edge surface, a first side surface and a second side surface, with the first and second side surfaces being oppositely disposed. The door is movably mounted. The sensing edge comprises an elongate base member for being secured to the leading edge surface of the door. An elongate outer sheath having first and second ends and first and second opposing outer surfaces is provided. The outer surface of the elongate outer sheath is connected to the elongate base member. First and second end members sealingly enclose the first and second ends of the outer sheath to create an enclosed, sealed cavity. An aperture is defined through the first outer surface of the sheath in proximity to the first end of the sheath and in fluid communication with the cavity. An L-shaped conduit is pivotally disposed in the aperture to provide a passage in fluid communication with the cavity. The L-shaped conduit is pivotable toward either of the first and second side surfaces of the door. The L-shaped conduit is adapted for connection to a tube for actuation of the door opening device upon detection of an increase in pressure within the cavity as a result of an external force being applied to the sheath.

The present invention also provides a sensing edge for causing a door to open by actuating a device upon force being applied to the sensing edge. The door has a leading edge surface, a first side surface and a second side surface, with the first and second side surfaces being oppositely disposed. The door is movably mounted. The sensing edge comprises an elongate outer sheath having first and second ends and first and second opposing outer surfaces which define a cavity, and first and second facing inner surfaces. The first outer surface is adapted for connection to the leading edge of the door. An elongate sensor is positioned within the cavity for detecting an external force applied to the sheath. The sensor extends substantially the entire length of the sheath between the first and second ends. At least one electrical conductor is provided in electrical communication with the sensor for connection with a circuit for controlling a device for opening and closing the door when the sensor detects the application of force to the sheath. An aperture is defined in the first outer surface of the sheath in proximity to the first end of the sheath and in communication with the cavity. An L-shaped conduit is pivotally disposed in the aperture to provide a passage in communication with the cavity. The L-shaped conduit is pivotable toward either of the first and second side surfaces of the door. The conductor extends through the L-shaped conduit.

The present invention also provides a method of constructing a sensing edge including an elongate outer sheath having first and second ends, first and second opposing outer surfaces and first and second facing inner surfaces, having a first strip of resiliently compressible material with a first face and a second face, with the first face being adhesively connected to one of the first and the second inner surfaces of the elongate outer sheath, a first strip of flexible, and electrically conductive material having a first face and a second face, with the first face of the first strip of flexible, electrically conductive material being affixed to the second face of the first strip of resiliently compressible material, a second strip of flexible, electrically conductive material having a first face and a second face, with the first face of the second strip of flexible, electrically conductive material being supported on the other of the first and second inner surfaces of the elongate outer sheath, the second face of the second strip of flexible, electrically conductive material facing the second face of the first strip of flexible, electrically conductive material, with an open space between the second face of the first strip of flexible, electrically conductive material and the second face of the second strip of flexible, electrically conductive material. The method comprising the steps of:

(a) threading a first end of the first strip of resiliently compressible material and a first end of the second flexible, electrically conductive material through parallel longitudinal bores of an assembly tool;

(b) peeling a portion of a first strip of backing paper from an adhesive coating on the first face of the first strip of resiliently compressible material at the first end thereof;

(c) adhering the first end of the first strip of resiliently compressible material to the one of the first and second inner surfaces of the elongate outer sheath at the first end thereof;

(d) peeling a portion of the second strip of backing paper from an adhesive coating on a first end of the second strip of flexible, electrically conductive material;

(e) adhering the first end of the second strip of flexible, electrically conductive material to the other of the first and second surfaces; and (f) simultaneously drawing the first strip of resiliently compressible material with the attached first strip of flexible, electrically conductive material and the second strip of flexible, electrically conductive material through the cavity in the outer sheath while peeling the first and second strips of backing paper from the adhesive coatings on the first face of the first strip of resiliently compressible and the first face of the second strip of flexible, electrically conductive material, such that the adhesive coating on the first face of the first strip of resiliently compressible material contacts the one of the first and second inner surfaces of the outer sheath to adhere the first strip of resiliently compressible material in position, and the adhesive coating on the first face of the second strip of flexible, electrically conductive material contacts the other of the first and second inner surfaces of the outer sheath, and adheres the second strip of flexible, electrically conductive material in position.

The present invention also provides a method of constructing a sensing edge including an elongate outer sheath having first and second ends, first and second opposing outer surfaces and first and second facing inner surfaces, having a first strip of resiliently compressible material with a first face and a second face, with the first face being adhesively connected to one of the first and the second inner surfaces of the elongate outer sheath, a first strip of flexible, electrically conductive material having a first face and a second face, with the first face of the first strip of flexible, electrically conductive material being affixed to the second face of the first strip of resiliently compressible material, and a second strip of resiliently compressible material with a first face and a second face, the first face of the second strip of resiliently compressible material being adhesively connected to the other of the first and the second inner surfaces of the elongate outer sheath, a second strip of flexible, electrically conductive material having a first face and a second face, with the first face of the second strip of flexible, electrically conductive material being affixed to the second face of the second strip of resiliently compressible material, the second face of the second strip of flexible, electrically conductive material facing the second face of the first strip of flexible, electrically conductive material, with an open space between the second face of the first strip of flexible, electrically conductive material and the second face of the second strip of flexible, electrically conductive material. The method comprising the steps of:

(a) threading the first ends of the first and second strips of resiliently compressible material through parallel longitudinal bores of an assembly tool;

(b) peeling a portion of a first strip of backing paper from an adhesive coating on the first face of the first strip of resiliently compressible material at a first end thereof;

(c) adhering the first end of the first strip of resiliently compressible material to a selected one of the first and second inner surfaces of the elongate outer sheath at the first end thereof;

(d) peeling a portion of a second strip of backing paper from an adhesive coating on the first face of the second strip of resiliently compressible material at a first end thereof;

(e) adhering a first end of the second strip of resiliently compressible material to the other of the first and second inner surfaces of the elongate outer sheath at the first end thereof;

(f) simultaneously drawing the first and second strips of resiliently compressible material with the attached first and second strips of flexible, electrically conductive material through the cavity in the outer sheath while peeling the first and second strips of backing paper from the adhesive coatings on the respective first faces of the first and second strips of resiliently compressible material, such that the adhesive coating on the first face of the first strip of resiliently compressible material contacts the one of the first and second inner surfaces of the outer sheath to adhere the first strip of resiliently compressible material in position as the first strip of resiliently compressible material advances through the cavity, and the adhesive coating on the first face of the second strip of resiliently compressible material contacts the other of the first and second inner surfaces of the outer sheath to adhere the second strip of resiliently compressible material in position as the second strip of resiliently compressible material advances through the cavity in the elongate outer sheath.

The present invention also provides a tool for assembling a sensing edge having an elongate outer sheath with a cavity defined therein, the cavity having a relaxed opening height defined between facing first and second inner surfaces thereof and an expanded opening height defined between the first and second inner surfaces as the assembly tool is inserted, and first and second strips of material being affixed to the first and second facing inner surfaces. The tool comprises an elongate body having first and second opposing outer surfaces, first and second ends, and first and second parallel longitudinal bores defined therethrough. The body has a height defined by the first and second opposing outer surfaces. The height of the body is less than the expanded opening height of the outer sheath. A first end surface is located between a first end of the first bore and the first opposing outer surface and is adapted to invert the first strip of material as it is drawn through the first bore and applied to the first inner surface. A second end surface is located between a first end of the second bore and the second opposing outer surface and is adapted to invert the second strip of material as it is drawn through the second bore and applied to the second inner surface.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
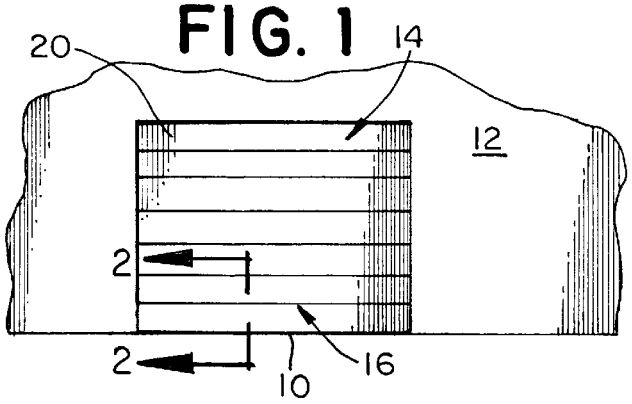
FIG. 1 is a an elevational view showing a door construction including a sensing edge in accordance with a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the sensing edge and designated parts thereof. The terminology includes the words specifically mentioned above, derivatives thereof and words of similar import.

Figure 2:
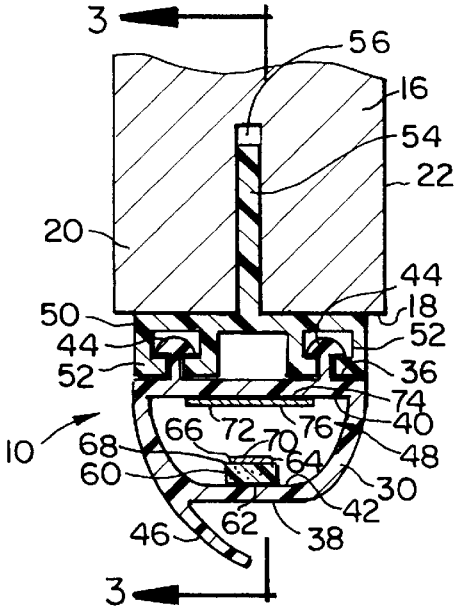
FIG. 2 is a greatly enlarged cross-sectional view of a sensing edge in accordance with a first preferred embodiment of the present invention taken along lines 2—2 in FIG. 1.
Figure 3:
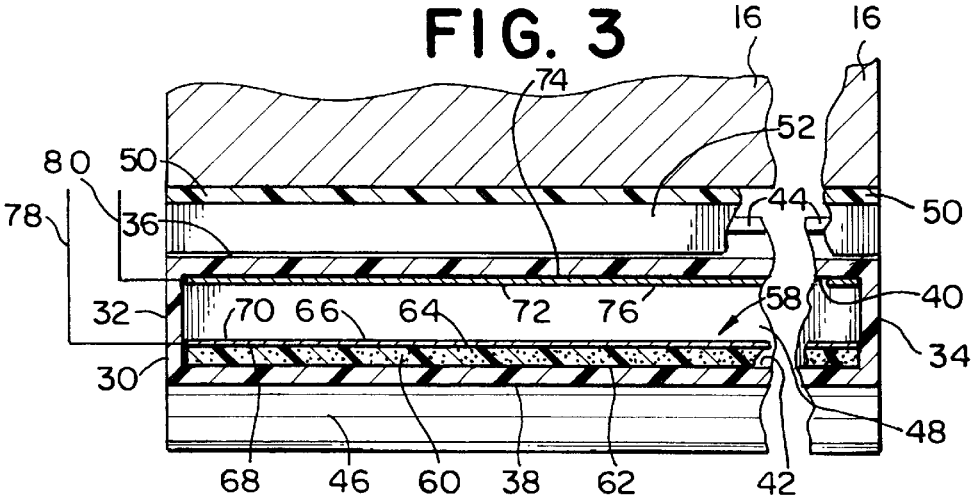
FIG. 3 is a cross-sectional view of a portion of the sensing edge shown in FIG. 2 taken along lines 3—3 of FIG. 2.

Referring to the drawings, wherein like numerals indicate like elements throughout, there is shown in FIGS. 1–3 a first preferred embodiment of a sensing edge 10 in accordance with the present invention. The sensing edge 10 is intended for use with automatically closing doors to protect persons, equipment and the door from impact damage from closing movement of the door by causing the door to open by actuating a device upon force being applied to the sensing edge. Stopping devices for automatically closing doors are generally known to those of ordinary skill, and may comprise a relay or switch which interrupts current to the door-closing device, or reverses movement of the door-closing device. It is also understood by the ordinarily skilled artisan that the specific type of door-closing mechanism and stopping device are not pertinent to the present invention, and can be varied, and accordingly further description is not believed necessary or limiting.

Referring to FIG. 1, there is shown a building wall 12 having a doorway 14 with a door 16. While the door 16, as illustrated, is an overhead door having a sensing edge 10 in accordance with the present invention, it is within the scope and spirit of the invention to incorporate the sensing edge 10, described hereinafter, along an edge of any door structure, such as vertically or horizontally movable doors (not shown) as desired. Moreover, it is understood by those of ordinary skill in the art that the sensing edge 10 is not limited to use in conjunction with doors, but can be used for other applications, such as automatic windows.

Referring now to FIG. 2, the first preferred embodiment of the sensing edge 10 installed on the door 16 is shown in detail. The door 16 has a leading edge surface 18, a first side surface 20 and a second side surface 22.

The first and second side surfaces 20 and 22 are oppositely disposed, and the door 16 is movably mounted within the doorway opening 14.

The sensing edge 10 comprises an elongate outer sheath 30 having first and second ends 32 and 34, first and second opposing outer surfaces 36 and 38 and first and second facing inner surfaces 40 and 42 which define a cavity 48. The first outer surface 36 of the elongate outer sheath 30 is adapted for connection to the leading edge 18 of the door 16. Preferably, the first outer surface 36 of the elongate outer sheath 30 includes two male connector members 44 which protrude from the first outer surface 36 of the sheath 30. A secondary lip seal 46 is also preferably provided attached to the second opposing outer surface 38.

In the preferred embodiment, the elongate outer sheath 30 is made from a flexible, resilient material such as Santoprene™ 103-50 from Monsanto Co. having a Shore A durometer of approximately 60. Preferably, the sheath 30 is extruded, and the male connector members 44 are integrally formed with the sheath 30. However, it is understood by those of ordinary skill in the art from the present disclosure that the sheath 30 can be made from other resilient materials, such as other suitable polymeric materials, and may be made by other methods, such as forming the sheath 30 by connecting the ends of a flat strip of polymeric material and attaching the male connector members 44 in a secondary operation.

Preferably, the first outer surface 36 of the elongate outer sheath 30 is secured to the leading edge surface 18 of the door 16 by an elongate base member 50. The base member 50 includes two female channel members 52 which are complementary to the male connector members 44 on the outer sheath 30, with the male connector members 44 on the sheath 30 being releasably engageable with the female channel members 52 of the base member 50. Preferably, a flange 54 is provided on the base member and is inserted into a suitable slot 56 along the leading edge surface 18 of the door 16 for mounting the base member 50 to the door 16. However, it will be recognized by those of ordinary skill in the art that the base member 50 may be provided without the flange 54 and can be installed on the leading edge 18 of the door 16 with an adhesive material, mechanical fasteners such as screws or nails, or other suitable attachment means.

The base member 50 is preferably molded from a polymeric material. In the preferred embodiment, the base member 50 is extruded from Santoprene™ 103-50 which is available from Monsanto Co. However, it is understood by those of ordinary skill in the art from the present disclosure that the base member 50 could made by other methods, such as machining or bending from a variety of materials, such as aluminum or other metals, or other suitable polymeric materials, such as polyvinyl chloride, neoprene, if desired. It is similarly understood by those of ordinary skill in the art that the male connectors could be attached to the base member 50 and the female channels 52 provided on the elongate outer sheath 30. Accordingly, the type of attachment employed between the elongate outer sheath 30 and the base member 50 may be made by various other suitable means, such as adhesive attachments or the use of other suitable connector attachments, such as interlocking channel members, or a combination of adhesive attachment and attachment by mating connectors (especially in industrial environments), or other suitable means, and the type of attachment utilized is not considered limiting. It is also understood by those of ordinary skill in the art that the base member 50 could be omitted in certain applications and the sheath 30 could be directly attached to the leading edge 18 of the door 16 by an adhesive, or any other suitable attachment means.

Still with reference to FIGS. 2 and 3, an elongate sensor 58 is provided in the outer sheath 30. The sensor 58 includes a first strip of resiliently compressible material 60 having a first face 62 and a second face 64. The first face 62 is affixed to one of the first and second inner surfaces 40 and 42 of the elongate outer sheath 30. Preferably, the first strip of resiliently compressible material 60 is affixed to the second inner surface 42 with an adhesive, as shown in FIGS. 2 and 3. However, it will be understood by those of ordinary skill in the art from the present disclosure that the first face 62 of the first strip 60 could be affixed to the first inner surface 40, if desired. Preferably, the first strip of resiliently compressible material 60 has a width of approximately 0.3 inches, a thickness of approximately 0.125 inches, and extends the length of the elongate outer sheath 30. The width of the first strip of resiliently compressible material 60 is less than one-fourth of the width of the outer sheath 30. However, it will be understood by those of ordinary skill in the art from the present disclosure that the width and thickness of the first strip of resiliently compressible material 60 can be varied, depending upon the particular application.

A first strip of flexible, electrically conductive material 66 having a first face 68 and a second face 70 is provided with the first face 68 of the first strip of flexible, electrically conductive material 66 being affixed to the second face 64 of the first strip of resiliently compressible material 60. The first strip of flexible, electrically conductive material 66 has a width of approximately 0.3 inches, is less than 0.030 inches thick, and extends the length of the outer sheath 30. The width of the flexible, electrically conductive sheet 66 is less than one-fourth of the width of the outer sheath 30, and substantially reduces the amount and cost of the material required in comparison to the conductive sheets of the prior art.

A second strip of flexible, electrically conductive material 72 having a first face 74 and a second face 76 is provided with the first face 74 of the second strip of flexible, electrically conductive material 72 being supported on the other of the first and second inner surfaces 40 and 42 of the elongate outer sheath 30. The second face 76 of the second strip of flexible, electrically conductive material 72 faces the second face 70 of the first strip of flexible, electrically conductive material 66. Preferably, the second strip of flexible, electrically conductive material 72 is made of the same material as the first strip of flexible, electrically conductive material 66, and has a width of approximately 0.55 inches, and is centered with respect to the first strip of flexible, electrically conductive material 66. This provides a greater area for contact to occur between the first and second flexible, electrically conductive strips 66 and 72 in the event that the outer sheath 30 does not maintain the alignment between the conductive strips 66, 72 when they are deflected together.

An open space 48 is provided between the second face 70 of the first strip of flexible, electrically conductive material 66 and the second face 76 of the second strip of flexible, electrically conductive material 72. The first and second strips of flexible, electrically conductive material 66 and 72 form a sensor or switch for detection of an external force applied to the sheath 30, whereby the first strip of resiliently compressible material 60 is adapted to allow displacement of the first strip of flexible, electrically conductive material 66 when the outer sheath 30 is folded for shipping to prevent cracking of the first strip of flexible, electrically conductive material 66. The first strip of resiliently compressible material 60 allows longitudinal displacement of the first strip of flexible, electrically conductive material 66 as the outer sheath 30 is bent or folded, which prevents the first strip of conductive material 66 from stretching or becoming disconnected from the first or second inner surfaces 40, 42 of the outer sheath 30. Additionally, when the outer sheath 30 is unfolded, the first strip of flexible, electrically conductive material 66 returns to its original position as the tension and bending forces on the first strip of resiliently compressible material 60 are relieved, which prevents cracking or separation of the first strip of conductive material 66. This is accomplished with a reduced amount of material locate in the sheath 30 in comparison to the prior art sensing edges, which required a positive stack up of foam between the inner surfaces 40, 42 of the outer sheath 30 to resiliently maintain the conductive strips in position. By using less material, the present sensing edge 10 cheaper and easier assembly than the prior art devices.

In the preferred embodiment, the first strip of resiliently compressible material 60 is preferably made of open or closed cell foam rubber. However, it is understood by those of ordinary skill in the art from the present disclosure that the first strip of resiliently compressible material 60 may be made by other suitable materials, such as a generally soft rubber or other elastic polymeric material. Preferably, the first and second strips of electrically conductive material 66 and 72 are constructed from thin aluminum or aluminum foil. However, it is within the spirit and scope of the present invention to construct the first and/or second strip of any other suitable flexible, electrically conductive material such as copper, brass or an electrically conductive flexible plastic or a foil or metallic coating on a woven cloth material.

In use, if an object comes into contact with the outer sheath 30 as the door 16 closes, the second inner surface 42 of the outer sheath 30 is deflected toward the first inner surface 40 until the first and second flexible, electrically conductive strips 66, 72 on the inner surfaces 40, 42 of the outer sheath 30 contact each other. This contact between the conductive strips 66, 72 acts as a switch.

As shown in FIG. 3, electrical conductors or wires 78 and 80 are connected to the first and second flexible, electrically conductive strips 66 and 72, respectively. The conductors 78 and 80 may extend out from the first end 32 of the outer sheath 30, as shown or may be pulled through apertures (not shown) formed in or punched through the first outer surface 36 or a side of the outer sheath 30. The electrical conductors 78 and 80 are used in connection with a circuit (not shown) for controlling the actuation of the stopping device on the door 16 in response to the application of force to the sheath 30. Alternatively, a battery powered radio transmitter (not shown) could be provided in connection with the conductor 78 and 80 for communication with the circuit (not shown) for controlling the actuation of the stopping device to render the sensing edge 10 wireless. Such a transmitter could maintain the door 16 in the closed position upon the battery becoming drained.

Figure 4:
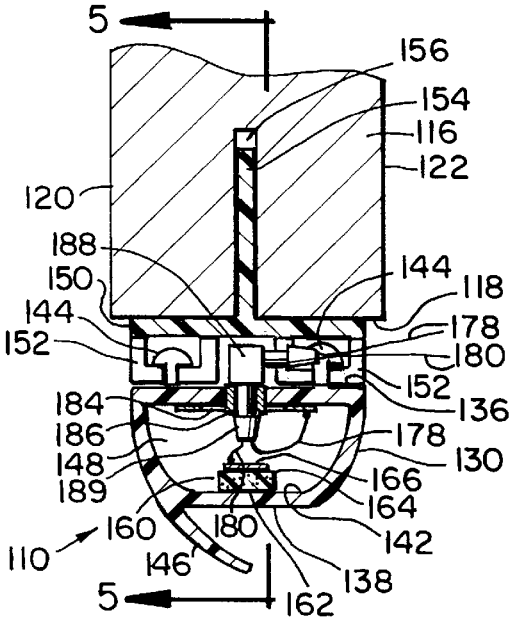
FIG. 4 is a greatly enlarged cross-sectional view similar to FIG. 2 showing a second embodiment of a sensing edge in accordance with the present invention.
Figure 5:
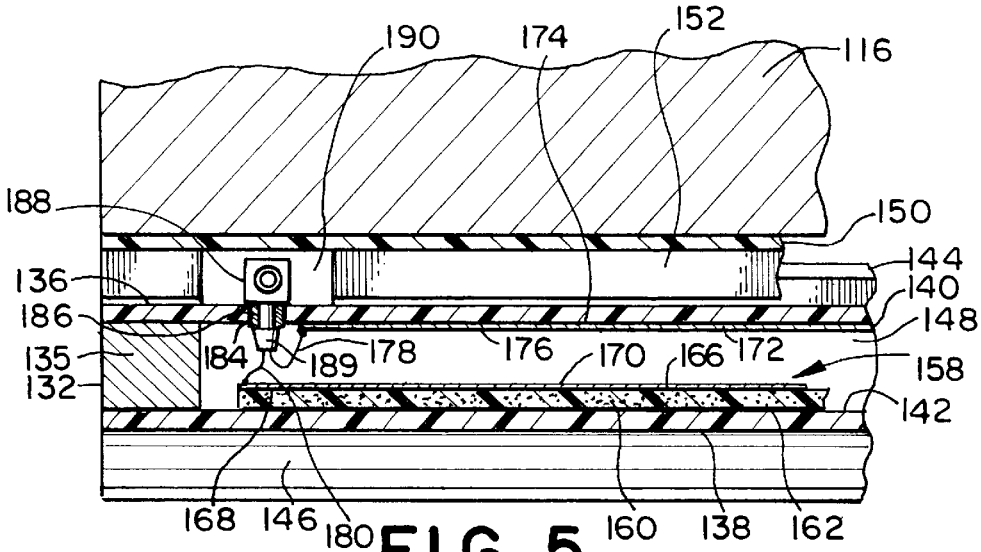
FIG. 5 is a cross-sectional view of a portion of the sensing edge shown in FIG. 4 taken along lines 5—5 of FIG. 4.

Referring now to FIGS. 4 and 5, a second embodiment of the sensing edge 110 for causing the door 16 to open by actuating a device upon force being applied to the sensing edge 110 is provided. The door 16 is as previously described, and the second embodiment of the sensing edge 110 is similar to the first embodiment and like elements in the drawings are identified with similar reference numerals including the prefix "1". For example, the outer sheath 130 of the second embodiment of the sensing edge 110 is similar to the elongate outer sheath 30 of the first embodiment of the sensing edge 10. Accordingly, reference numerals for all the elements have been provided in the drawing figures for convenience only, and only the differences from the first embodiment are described in detail below.

The sensing edge 110 includes an elongate outer sheath 130, similar to the outer sheath 30 described above. The first and second ends 132 and 134 include stop blocks 135 which close off the ends of the outer sheath 130 to define a cavity 148 therein. The stop blocks 135 are preferably made of a rubber material having a Shore A hardness durometer which is the same as or greater than the hardness of the outer sheath 130. However, it is understood by those of ordinary skill in the art from the present disclosure that the stop blocks 135 may be made of any type of metallic, rubber, polymeric, or any other suitable material, as long as it closes off the ends of the elongate outer sheath 130.

An elongate sensor 158, which preferably comprises the first and second strips of flexible, electrically conductive material 166 and 172 mounted on the facing inner surfaces 140 and 142 of the elongate outer sheaths 130, is positioned within the cavity 148 for detecting an external force supplied to the outer sheath 130. The sensor 158 extends substantially the entire length of the outer sheath 130 between the first and second ends 132 and 134.

At least one electrical conductor, and preferably two conductors 178, 180, is provided in electrical communication with the sensor 158 for connection with a circuit (not shown) for controlling the device (not shown) for actuating the door 16 to open and close when the sensor 158 detects the application of force to the sheath 130.

An aperture 184 is defined in the first outer and inner surfaces 136 and 140 of the sheath 130 in proximity to the first end 132 of the sheath 130 and in fluid communication with the cavity 148. Preferably, a bushing 186 is installed in the aperture 184. The bushing 186 is preferably made of a polyvinyl chloride material and is adhesively secured in the aperture 184. An L-shaped conduit 188 is pivotally disposed in the aperture 184 to provide a passage for at least one conductor and preferably both conductors 178, 180.

Preferably, the L-shaped conduit 188 is made of PVC and is disposed in the bushing 186, with the L-shaped conduit 188 being pivotable to orient the conductors 178, 180 toward either of the first and second side surfaces 120 and 122 of the door 116. At least one conductor, and preferably both conductors 178, 180, extends through the L-shaped conduit 188.

Preferably, the L-shaped conduit 188 includes an enlarged, tapered portion 189 which includes a shoulder which engages the bushing to retain the L-shaped conduit 188 in position, but which also allows the L-shaped conduit 188 to rotate or pivot within the bushing 186. The L-shaped conduit 188 is preferably disposed between the two male connector members 144 on the first outer surface 136 of the elongate outer sheath 130. The female channel members 152 and the male connector members 144 each include an opening or notch 190 located in proximity to the L-shaped conduit 188 such that the L-shaped conduit 188 can be pivotally oriented with the notches 190 toward one of the first and second side surfaces 120, 122 of the door 116. This allows the electrical conductors 178, 180 to be directed inwardly, away from the exposed face of the door 116, regardless of whether the sensing edge 110 is installed with the electrical connection on the left or right-hand edge of the door 116.

Still with reference to FIGS. 4 and 5, preferably the first and second electrical conductors 178 and 180 are provided, and the first strip of flexible, electrically conductive material 166 is in electrical contact with the first electrical conductor 178 and the second strip of flexible, electrically conductive 172 is in electrical contact with the second electrical conductor 180.

In use, the stop blocks 135 at the first and second ends 132 and 134 of the elongate outer sheath prevent the sensor 158 from being actuated when the door 116 is in the closed position and protect the conductors 178 and 180 from being crushed against the base of the L-shaped conduit 188. The sensor 158 works in the known manner, with the second outer surface 138 of the sensing edge 110 being deflected upward by an object in the path of the closing door 116. When the second outer surface 138 of the sheath 130 has deflected a sufficient distance, the first flexible, electrically conductive material 166 comes into contact with the second strip of flexible, electrically conductive material 172 to close the switch and actuate the device for stopping and/or reversing the movement of the door 116.

Figure 6:
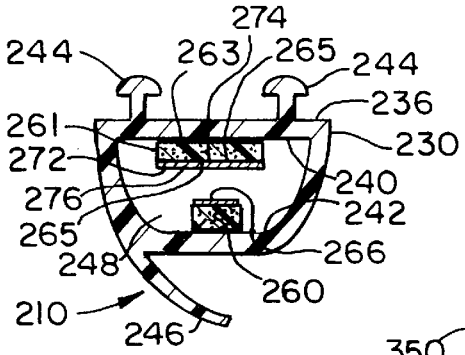
FIG. 6 is a partial cross-sectional view similar to FIG. 2 of a third preferred embodiment of a sensing edge in accordance with the present invention.

Referring now to FIG. 6, a third embodiment of the sensing edge 210 is shown. The third embodiment 210 is similar to the first and second embodiments 10, 110 and is mounted in a similar fashion, and may include the L-shaped conduit 188, if desired. Similar reference numerals to the first embodiment of the sensing edge 10 including the prefix "2" have been used to identify similar elements. Accordingly, reference numerals for all the elements have been provided in the drawing figures for convenience only, and the description below will be limited to the differences between the third embodiment of the sensing edge 210 and the first embodiment of the sensing edge 10.

In the third embodiment of the sensing edge 210, a second strip of resiliently compressible material 261 having a first face 263 and a second face 265 is provided between the other of the first and second inner surfaces 240 and 242 of the elongate outer sheath 230. In the preferred embodiment, the second strip of resiliently compressible material 261 is provided between the first inner surface 240 of the elongate outer sheath and the second strip of flexible, electrically conductive material, with the first face 263 of the second strip 261 being affixed to the other of the first and second inner surfaces 240, 242 and the second strip of flexible, electrically conductive material 272 being affixed to the second face 265 of the second strip of resiliently compressible material 261. Preferably, the second strip of resiliently compressible material 261 is approximately the same width as the second strip of flexible, conductive material 272, which is about one half of the width of the outer sheath 230, and provides resiliently flexible support for the second conductive strip 272 without the need for filling the open space 248 between the first and second conductive strips 266, 272 with foam. The thickness of the second strip of resiliently compressible material 261 is preferably approximately 0.125 inches.

It will be recognized by those of ordinary skill in the art from the present disclosure that stop blocks similar to the stop blocks 135 discussed above in connection with the second embodiment of the sensing edge 110 may be utilized in connection with the third embodiment of the sensing edge at each of the first and second ends 232, 234 of the outer sheath 230, with the stop blocks 235 closing off the respective ends of the sheath 230. It will be similarly recognize d that an aperture similar to the aperture 184 in the second embodiment of the sensing edge 110 may be defined through the first outer and inner surfaces 236, 240 of the sheath 230, with at least one electrical conductor being electrically connected to each of the first and second strips of electrically conductive material 266, 272 to provide a connection with the circuit for controlling the device for actuating the do or to open and close. An L-shaped conduit, similar to the L-shaped conduit 188 described above, may also be provided pivotally disposed in the aperture to provide a passage for the conductors, with the L-shaped conduit being pivotable to orient the conductors toward either of the first and second side surfaces of a door.

A method of constructing a sensing edge 10, 110, 210 in accordance with the first, second and third embodiments of the present invention is described below in conjunction with FIGS. 10–13. The method for assembling the sensing edge in accordance with the first, second and third embodiments 10, 110, 210 is very similar, except in the first and second embodiments 10, 110, the second strip of flexible, conductive material 72, 172 is attached directly to the first inner surface 40, 140 of the sheath 30, 130, and in the third embodiment 210, the second strip of flexible, conductive material 272 is pre-assembled with a second strip of resiliently compressible material 261, as described in detail below.

Figure 10:
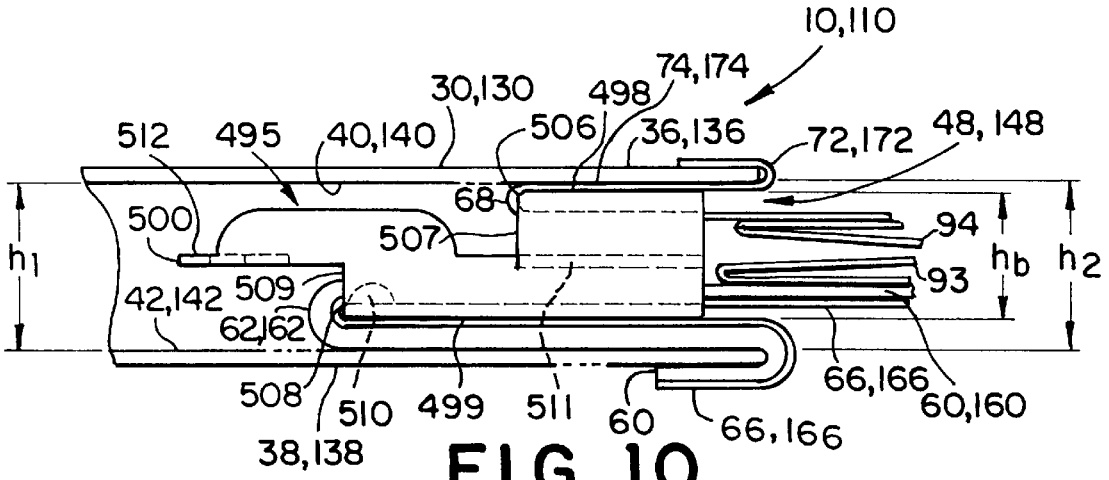
FIG. 10 is a side elevational view of the sensing edge of FIG. 2. being assembled with an assembly tool in accordance with the present invention.
Figures 11, 12:
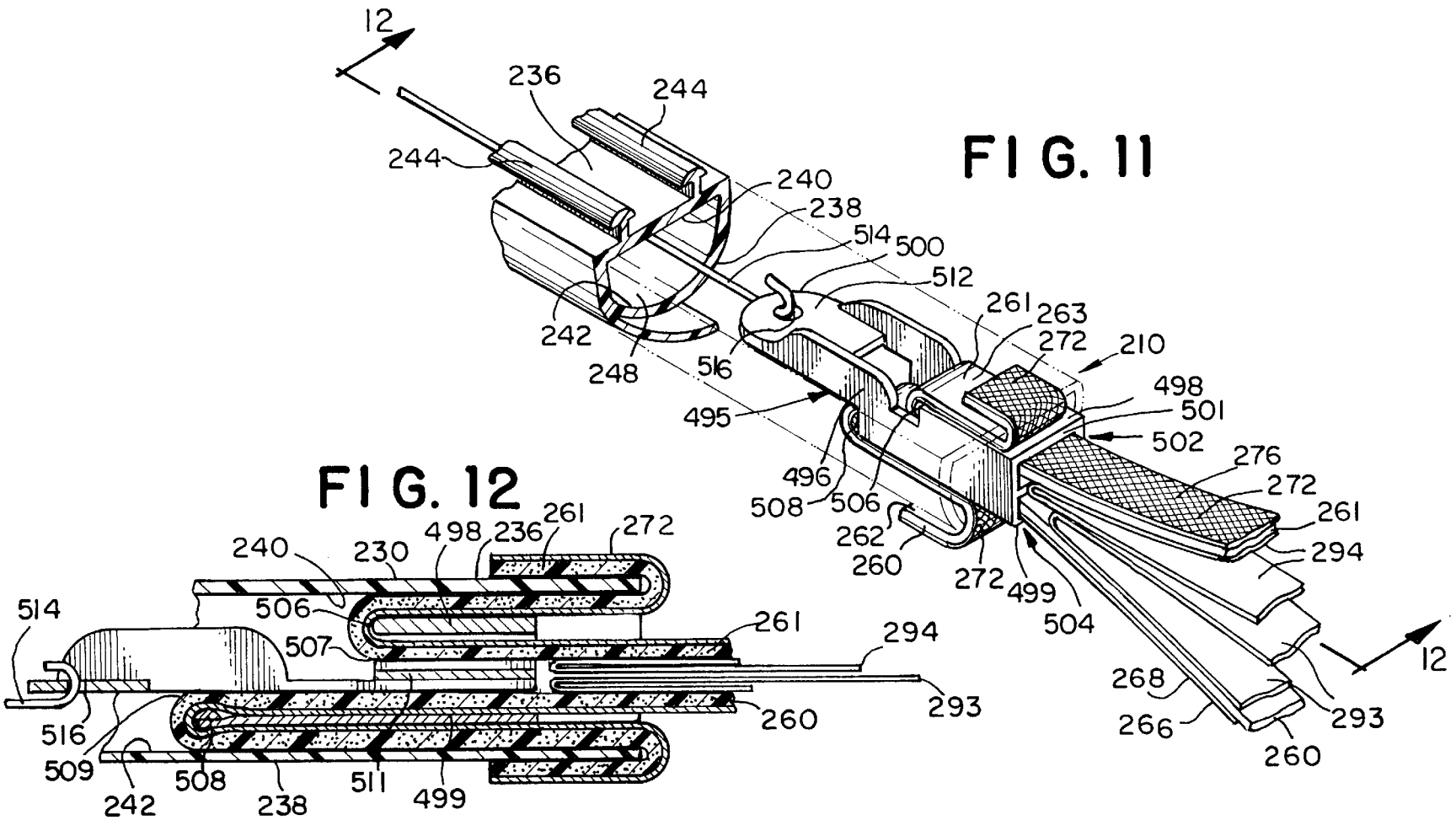
FIG. 11 is a perspective view of the sensing edge of FIG. 6 being assembled with an assembly tool in accordance with the present invention.
FIG. 12 is a section view taken along line 12—12 of FIG. 11.

Referring to FIGS. 10–12, the sheath 30, 130, 230 is extruded from a desired material, such as Santoprene 103-50, as noted above. The sheath 30, 130, 230 includes the cavity 48, 148, 248 which has a relaxed opening height $h_1$ defined between facing first and second inner surfaces 40, 42; 140, 142; 240, 242 thereof and an expanded opening height $h_2$ defined between the first and second inner surfaces 40, 42; 140, 142; 240,242 as an assembly tool 495 is inserted, as explained in detail below.

In the first and second embodiments, the second strip of flexible, electrically conductive material 72, 172 is provided with adhesive on its first face 74, 174 and a strip of backing paper 94. The first strip of resiliently compressible material 60, 160 is preassembled with the first strip of flexible, electrically conductive material 66, 166, as shown in FIG. 10, and a strip of backing paper 93 is removably affixed to the first surface 62, 162.

In the third embodiment 210, two strips of resiliently compressible material 260, 261 are provided with adhesive on both surfaces, and the first and second strips of flexible, electrically conductive material 266, 272 are bonded to the second faces 264, 265 of the first and second strips of resiliently compressible material 260, 261, respectively. Strips of backing paper 293, 294 are provided on the first faces 262, 263 of the strips of resiliently compressible material 260, 261 to protect the adhesive surface until they are assembled with the sheath 230.

Referring again to FIGS. 10–12, to assemble the now pre-assembled strip of resiliently compressible material and flexible, electrically conductive strips 60, 66; 160, 166 and the second strip of flexible, electrically conductive material 72, 172 of the first and second embodiments 10, 110 with the outer sheath 30, 130, and to assemble the pre-assembled first and second strips of resiliently compressible material and the first and second strips of flexible, electrically conductive material 260, 266 and 261, 272, with the outer sheath 230 of the third embodiment of the sensing edge 210, the assembly tool 495 is provided.

Figure 13:
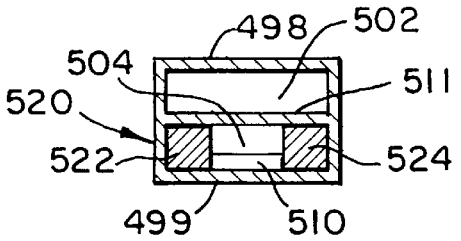
FIG. 13 is a sectional view of another embodiment of an assembly tool in accordance with the present invention.

The assembly tool 495 comprises an elongate body 496 having first and second opposing outer surfaces 498, 499 and first and second ends 500, 501. First and second parallel longitudinal bores 502, 504 are defined through the elongate body 496. Preferably, the first and second longitudinal bores 502, 504 have rectangular cross sections which correspond generally to the cross sections of the first and second strips of resiliently compressible material 60, 160, 260, 261 with the attached first and second sheets of flexible, electrically conductive material 66, 166, 266, 272, respectively. As shown in FIG. 13, spacers 522, 524 may be located in the first and/or second bores 502, 504 to center the strip of resiliently compressible material 60, 160, 260, if the width of the strip of resiliently compressible material 60, 160, 260 is substantially narrower than the bore 502, 504, as illustrated in FIGS. 2, 4 and 6, to ensure that the strips of resiliently compressible material 60, 160, 260 are assembled in a centered position with respect to the sheath 30, 130, 230.

A first end surface 506 is located between a first open end 507 of the first bore 502 and the first opposing outer surface 498 of the tool 495, and is adapted to invert the second strip of flexible, electrically conductive material 72, 172 of the first and second embodiments 10, 110, as shown in FIG. 10, or the pre-assembled second strip of resiliently compressible material 261 and the second sheet of flexible, electrically conductive material 272 of the third embodiment 210, as shown in FIGS. 11 and 12, as they are drawn through the first bore 502 and applied to the first inner surface 40, 140, 240 of the outer sheath 30, 130, 230. Preferably, the first end surface 506 is a smoothly rounded surface.

A second end surface 508 is located between a first end 509 of the second bore 504 and the second opposing outer surface 499 of the tool 495, and is adapted to invert the pre-assembled first strip of resiliently compressible material 60, 160, 260 and the first strip of flexible, electrically conductive material 66, 166, 266, as it is drawn through the second bore 504 and applied to the second inner surface 42, 142, 242 of the outer sheet 30, 130, 230. Preferably, the second end surface 508 comprises a rounded first end of the second outer surface 499 and a semi-cylindrical member 510 affixed to the second outer wall 499 adjacent to the first end 509 thereof.

Preferably, an interior partition 511 extends between the first and second longitudinal bores 502 and 504. Preferably, the elongate body 496 has a height defined by the first and second opposing outer walls 498, 499, with the height being less than the expanded opening height $h_2$ of the outer sheath 230. In the preferred embodiment, the relaxed opening height $h_1$ of the outer sheath 30, 130, 230 is approximately 0.6 inches, the height of the elongate body 496 is approximately 0.7 inches and the expanded opening height is 0.72 inches or greater, depending on the thicknesses of the strips of flexible, electrically conductive material 66, 72; 166, 172; 266, 272, as well as the compressed height of the strip(s) of resiliently compressible material 60, 160, 260, 261, as explained in detail below.

A support 512 is located at a medial position adjacent to the first end 500 of the assembly tool 495, and includes means for attaching a pull device. In the preferred embodiment, an aperture 516 is provided in the support member 512 and the pull device comprises a hook 514 formed on the end of a line such as a length of wire which is longer than the length of the outer sheath 30, 130, 230, with the hook 514 being inserted in the aperture 516.

In the preferred embodiment, the elongate body 496 is made of a strong, lightweight material, such as aluminum, and the first wall 498 is made of a polymeric material which is bonded in place. However, it will be recognized by those skilled in the art from the present disclosure that the entire body 496 can be made from various metallic or polymeric materials, if desired. Additionally, the body 496 may be assembled from separate channel sections which are bonded together, or may be machined or molded as a one-piece construction. It will be similarly understood that the means for attaching a pull device may comprise a bar which can be engaged by a hook, an aperture, as presently preferred, or any other suitable means for attaching a pull device.

Referring again to FIG. 10, to assemble the sensing edge 10, 110 in accordance with the first and second embodiments of the invention, the first strip of resiliently compressible material 60, 160, having the first strip of flexible, electrically conducted material 66, 166 pre-assembled to the second face 64, 164 thereof and the second strip of flexible, electrically conducted material 72, 172 are drawn through the cavity 48 in the elongate outer sheath 30 using the assembly tool 495. A first end of the second strip of resiliently compressible material 60, 160 and a first end of the second flexible, electrically conductive material 72 are threaded through the parallel longitudinal bores 502, 504 of the assembly tool 495. Preferably, the first strip of resiliently compressible material 60, 160 with the attached first strip of flexible, electrically conductive material is threaded through the second bore 504 and the second strip of flexible, electrically conductive material is threaded through the first bore 502 of the assembly tool 495, respectively. A portion of the first strip of backing paper 93 is peeled back from an adhesive coating on the first face 62, 162 of the first strip of resiliently compressible material 60, 160 at the first end thereof. The first end of the first strip of resiliently compressible material 60, 160 is adhered to one of the first and second inner surfaces 40, 42; 140, 142 of the elongate outer sheath 30, 130 at the first end thereof. In the preferred embodiment, the first strip of resiliently compressible material 60, 160 is adhered to the second inner surface 42, 142. Preferably, a portion of the first end of the first strip of resiliently compressible material 60, 160 is wrapped around the first end of the outer sheath 30, 130 and adhered to the second outer surface 38, 138.

A portion of the second strip of backing paper 94 is peeled from an adhesive coating on a first end of the second strip of flexible, electrically conductive material 72, 172. The first end of the second strip of flexible, electrically conductive material 72, 172 is adhered to the other of the first and second inner surfaces 40, 42; 140, 142 of the outer sheath 30. In the preferred embodiment, the first face 74, 174 of the second strip of flexible, electrically conductive material 72, 172 is adhered to the first inner surface 40, 140 of the outer sheath 30, 130. Preferably, a portion of the first end of the second strip of flexible, electrically conductive material 72, 172 is adhered to the first outer surface 36, 136 of the outer sheath 30, 130, before the assembly tool 495 is inserted into the cavity 48, 148.

The first strip of resiliently compressible material 60, 160 with the attached first strip of flexible, electrically conductive material 66, 166 and the second strip of flexible, electrically conductive material 72, 172 are simultaneously drawn through the cavity 48, 148 in the outer sheath 30, 130 and are inverted while peeling the first and second strips of backing paper 93, 94 from the adhesive coatings on the first face 62, 162 of the first strip of resiliently compressible material 60, 160 and the first face 74, 174 of the second strip of flexible, electrically conductive 72, 172, such that the adhesive coating on the first face 62, 162 of the first strip of resiliently compressive material 60, 160 contacts the one of the first and second inner surfaces 40, 42; 140, 142 to adhere the first strip of resiliently compressible material 60, 160 in position, and the adhesive coating on the first face 74, 174 of the second strip of flexible, electrically conductive material 72, 172 contacts the other of the first and second inner surfaces 40, 42; 140, 142 of the outer sheath 30, 130, and adheres the second strip of flexible, electrically conductive material 72, 172 in position.

Preferably, based on the height $h_b$ of the assembly tool 495, a force is applied to the first strip of resiliently compressible material 60, 160 in a direction normal to the one of the first and second inner surfaces 40, 42; 140, 142, and preferably to the second inner surface 42, 142 of the elongate outer sheath 30, 130 to adhere the first strip of resiliently compressible material 60, 160 in position as the first strip of resiliently compressible material 60, 160 is being drawn through the cavity 48, 148 in the elongate outer sheath 30, 130.

Preferably, a force is also applied to the second strip of flexible, electrically conductive material 72, 172 in a direction normal to the other of the first and second inner surfaces 40, 42; 140, 142, and preferably the first surface 40, 140 of the elongate outer sheath 30, 130 to adhere the second strip of flexible, electrically conductive material 72, 172 in position as the second strip of flexible, electrically conductive material 72, 172 is being drawn through the cavity 48, 148 in the elongate outer sheath 30, 130.

Preferably, the first strip of resiliently compressible material 60, 160 has a first thickness $t_1$, and the attached first strip of flexible, electrically conductive material 66, 166 has a second thickness of $t_2$. The second strip of flexible, electrically conductive material 72, 172 has a third thickness of $t_3$, which is preferably the same as the second thickness $t_2$. The assembly tool 495 includes a body 496 having a height hb defined by the formula:

$$h_b=h_1-(t_1+t_2+t_3)<h_b<h_2.$$

Those skilled in the art will recognize that the application force exerted by the tool 495 on the first strip of resiliently compressible material 60, 160 with the attached first strip of resilient, electrically conductive material 66, 166 and the second strip of flexible, electrically conductive material 72, 172 depends on the height $h_b$ of the assembly tool body 496 the thicknesses $t_1$, $t_2$, $t_3$ of the strips of material, the relaxed opening height $h_1$ of the outer sheath 30, the expanded opening height $h_2$ of the outer sheath 30, 130 (which is a function of the shape of the outer sheath 30, 130 as well as resiliency of the outer sheath material), and the compressibility of the first strip of resiliently compressible material 60. The height $h_b$ has to be determined based on all of these factors in order for the strips of material to be firmly secured in position on the first and second inner surfaces 40, 42; 140, 142, while still allowing the assembly tool 495 to be drawn through the cavity 48, 148.

Referring to FIGS. 11 and 12, the method of constructing a sensing edge 210 in accordance with the third preferred embodiment of the invention includes drawing the first and second strips of resiliently compressible material 260, 261, with the pre-assembled first and second strips of flexible, electrically conductive material 266, 272 through the cavity 248 in the elongate outer sheath 230 using the assembly tool 495, as described above. The first strip of resiliently compressible material has a first thickness $t_1$, and the attached first strip of flexible, electrically conductive material 266 has a second thickness $t_2$. The second strip of flexible, electrically conductive material 272 has a third thickness $t_3$, and the second strip of resiliently compressible material has a fourth thickness $t_4$. The body 496 of the assembly tool 495 has a height $h_b$ defined by the formula:

$$h_b=h_1-(t_1+t_2+t_3+t_4) \text{ is } <h_b<h_1.$$

The first ends of the first and second pre-assembled strips of resiliently compressible material 260, 261 are threaded through the parallel longitudinal bores 502, 504 of the assembly tool 495. Preferably, the first strip of resiliently compressible material 260 is threaded through the second bore 504, and the second strip of resiliently compressible material 261 is threaded through the first bore 502.

A first strip of backing paper 293 is peeled from adhesive coating on the first face 262 of the first strip of resiliently compressible material 260 at a first end thereof, with the first strip of flexible, electrically conductive material 266 being affixed to the second face 264 thereof. The first end of the strip of resiliently compressible material 260 is adhered to one of the first and second inner surfaces 240, 242 of the elongate other sheath 230 at the first end thereof. In the preferred embodiment, the first strip of resiliently compressible material 260 is adhered to the second inner surface 242 of the outer sheath 230. Preferably, the first end of the first strip of resiliently compressible material 260 is also adhered to a portion of the second outer surface 238 of the outer sheath 230 at the first end thereof as the assembly tool 495 before inserted into the opening in the outer sheath 230. A portion of a second strip of backing paper 294 is peeled from the adhesive coating on the first face 263 of the second strip of resiliently compressible material 261 at a first end thereof, the second strip of flexible, electrically conductive material 272 being affixed to the second face 265 of the second strip of resiliently compressible material 261. A first end of the second strip of resiliently compressible material 261 is adhered to the other of the first and second inner surfaces 240, 242 of the elongate outer sheath 230 at the first end thereof. Preferably, the second strip of resiliently compressible material 261 is adhered to the first inner surface 240, as shown in FIGS. 11 and 12. Preferably, a portion of the second strip of resiliently compressible material 261 is adhered to the first outer surface 236 as the assembly tool 495 is inserted for ease of assembly.

The first and second strips of resiliently compressible material 260, 261 with the attached first and second strips of flexible, electrically conducted material 266, 272 are simultaneously drawn through the cavity 248 in the outer sheath 230 and are inverted while the first and second strips of backing paper 293, 294 are peeled from the adhesive coatings on the respective first faces 262, 263 of the first and second resiliently compressible strips 260, 261, such that the adhesive coating on the first face 262 of the first strip of resiliently compressible material 260 contact the one of the first and second inner surfaces 240, 242 of the outer sheath, preferably the second inner surface 242, to adhere the first strip of resiliently compressible material 260 in position as the first strip of resiliently compressible material 260 advances through the cavity 248. The adhesive coating on the first face 263 of the second strip of resiliently compressible material 261 contacts the other of the first and second inner surfaces 240, 242 of the outer sheath 230, preferably the first inner surface 240, to adhere the second strip of resiliently compressible material 261 in position as the second strip of resiliently compressible material 261 advances through the cavity 248 in the elongate outer sheath 230.

The first and second strips of resiliently compressible material 260, 261 are advanced by the assembly tool 495 which is drawn through the cavity 248 by the pull device, such as the wire having the hook 514 at one end thereof, which is inserted through the outer sheath 230 prior to being connected to the assembly tool 495.

Preferably, as the first strip of resiliently compressible material 260 is being installed, a force is applied in a direction normal to the one of the first and second inner surfaces 240, 242 and preferably the second inner surface 242 of the elongate outer sheath 230 to adhere the first strip of resiliently compressible material 216 in position as the first strip of resiliently compressible material 260 is being drawn through the cavity 248 in the elongate outer sheath 230.

Preferably, a force is also applied to the second strip of resiliently compressible material 261 in a direction normal to the other of the first and second inner surfaces 240, 242, and preferably the first inner surface 240, of the elongate outer sheath 230 to adhere the second strip of resiliently compressible material 261 in position as the second strip of resiliently compressible material 261 is being drawn through the cavity 248 in the elongate outer sheath 230.

After the strips of resiliently compressible material 60, 160 with the attached strip of flexible, electrically conductive material 66, 166 and the second strip of flexible, electrically conductive material 72, 172 are installed in the outer sheath 30, 130 of the first and second embodiments 10, 110, the wires 78, 80; 178, 180 are connected to the first and second strips of flexible, electrically conductive material 66, 72; 166, 172, respectively. The first and second ends 32, 34 are then installed on the ends of the outer sheath 30 of the first embodiment, with the wires protruding through the first end 32, as shown in FIG. 2.

In the second preferred embodiment 110, stop blocks 135 are inserted in the ends of the outer sheath 130 to seal the ends. The aperture 184 is formed in the outer sheath 130, and the bushing 186 is bonded in position, as shown in FIGS. 4 and 5. The wires 78, 80 are threaded through the bushing 186 and the L-shaped conduit 188, and the L-shaped conduit 188 is assembled into the bushing 186.

In the third preferred embodiment, after the strips of resiliently compressible material 260, 261 with the attached strips of flexible, electrically conductive material 266, 272, wires (not shown) are attached to the strips of flexible, electrically conductive material 266, 273, and the ends of the outer sheath 230 are closed in a similar fashion to the first embodiment 10.

Figure 7:
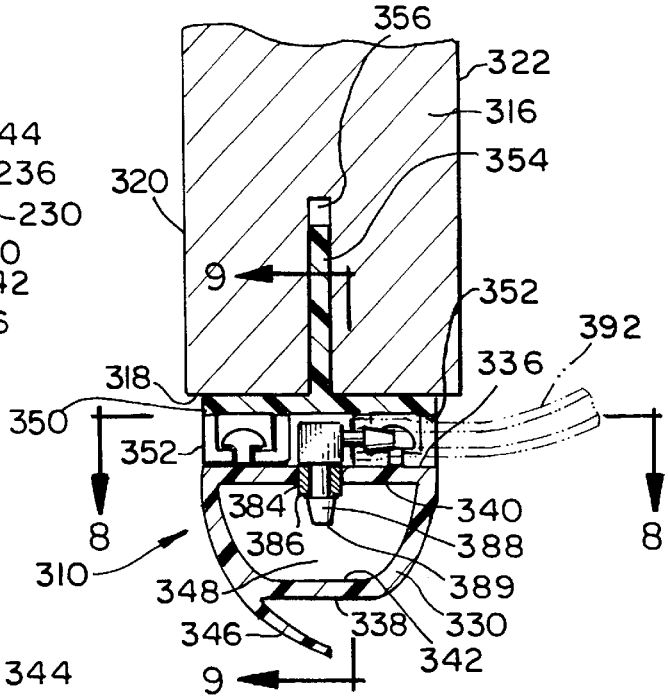
FIG. 7 is a cross-sectional view similar to FIG. 2 of a fourth preferred embodiment of a sensing edge in accordance with the present invention.
Figure 8:
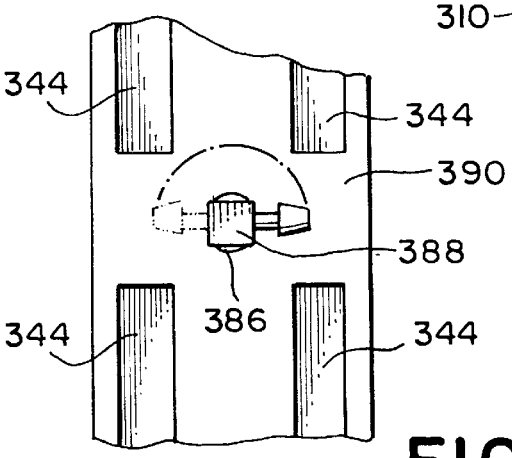
FIG. 8 is a top view of the sensing edge of FIG. 7 taken along lines 8—8 of FIG. 7.
Figure 9:
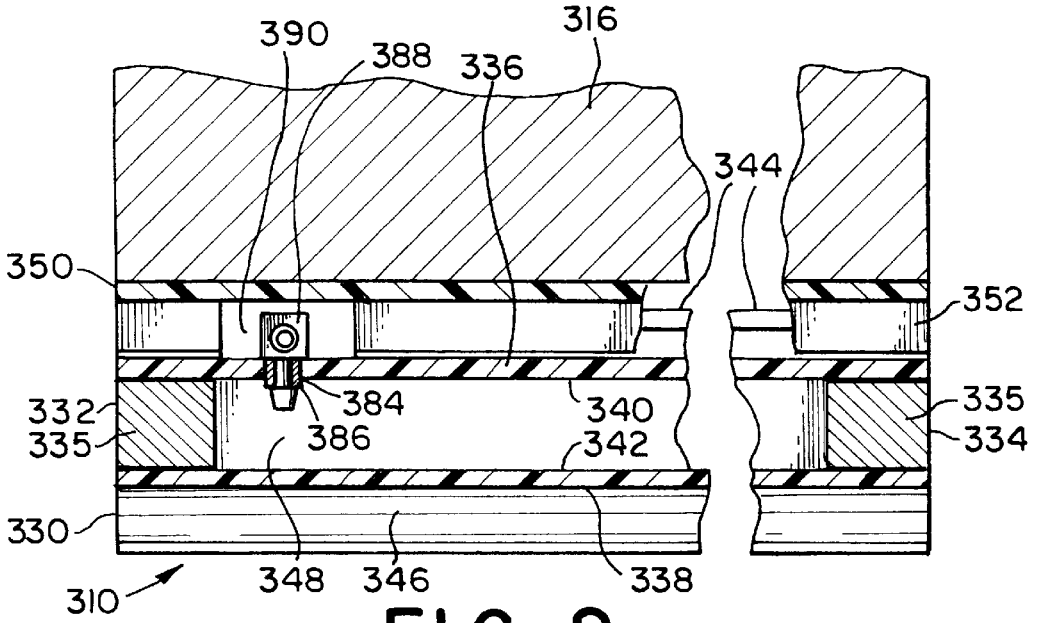
FIG. 9 is a partial cross-sectional view of the sensing edge of FIG. 7 taken along lines 9—9 of FIG. 7.

Referring now to FIGS. 7–9, a fourth embodiment of the sensing edge 310 is shown in detail. The fourth embodiment of the sensing edge 310 is similar to the previous embodiments and like elements have been identified with like reference numerals including the prefix "3". Accordingly, reference numerals for all the elements have been provided in the drawing figures for convenience only, and the following detail description will identify the differences between the fourth embodiment of the sensing edge 310 and the previous embodiments.

In the fourth preferred embodiment of the sensing edge 310, the elongate outer sheath 330 has first and second ends 332 and 334 and first and second opposing outer surfaces 336 and 338. The first outer surface 336 is connected to the elongate base member 350 by the male connector members 344 engaging the female channel members 352 on the base member 350, as previously described. First and second end members, which are preferably stop blocks 335, close the first and second ends 332 and 334 of the outer sheath 330 to create an enclosed, sealed cavity 348. An aperture 384 is defined through the first outer and inner surfaces 336 and 340 of the sheath 330 in proximity to the first end 332 of the sheath 332 and in fluid communication with the enclosed, sealed cavity 348. Preferably, a bushing 386 is located in the aperture 384 and bonded in position with an adhesive or otherwise sealingly engaged in the aperture 384. An L-shaped conduit 388 is pivotally and sealingly disposed in the aperture to provide a passage in fluid communication with the cavity 348. The L-shaped conduit 388 is pivotable toward either of the first and second side surfaces 320, 322 of the door 316. The L-shaped conduit 388 is adapted for connection to a pneumatic tube 392 for actuation of a door opening device (not shown) upon detection of an increase in pressure within the cavity 348 as a result of an external force being applied to the outer sheath 330. Preferably, the L-shaped conduit 388 is pivotally and sealingly disposed in the bushing 386, and the bushing 386 sealingly engages an outer surface of the L-shaped conduit 388.

In the preferred embodiment, the L-shaped conduit 388 has an enlarge, tapered portion 389 with a shoulder which engages the bushing 384 to retain the L-shaped conduit 388 in position. An enlarged, tapered portion 389 may also be provided on both ends of the L-shaped conduit 388 to provide improved connection for the pneumatic tube 392.

As shown most clearly in FIGS. 7 and 8, preferably the L-shaped conduit 388 is disposed between the two male connector members 344 on the elongate outer sheath 330. The female channel members 352 and the male connector members 344 each include a notch 390 located in proximity to the L-shaped conduit 388 such that the L-shaped conduit 388 can be pivotally oriented with the notches 390 toward one of the first and second side surfaces 320 and 322 of the door 316 to allow connection of the 392 through the notches 390.

Preferably, the tube 392 is connected to a pressure transducer (not shown) which detects a change in pressure and signals the door closing device to stop movement upon detection of an object which deflects the outer sheath 330 causing a change volume of the cavity 348. The use of the pivotable L-shaped conduit 388 allows the sensing edge 310 to be installed on the leading edge of existing doors 316 regardless of whether the location of the connections for the door stopping device are on the left or right hand side of the door.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A sensing edge for causing a door to open by actuating a device upon force being applied to the sensing edge, the door having a leading edge surface, a first side surface and a second side surface, the first and second side surfaces being oppositely disposed, the door being movably mounted, the sensing edge comprising:

an elongate outer sheath having first and second ends and first and second opposing outer surfaces which define a cavity, and first and second facing inner surfaces, the first outer surface being adapted for connection to the leading edge of the door;

an elongate sensor positioned within the cavity for detecting an external force applied to the sheath, said sensor extending substantially the entire length of the sheath between the first and second ends;

at least one electrical conductor in electrical communication with the sensor for connection with a circuit for controlling the device for opening and closing the door when the sensor detects the application of force to the sheath;

an aperture defined in the first outer surface of the sheath in proximity to the first end of the sheath and in communication with the cavity; and an L-shaped conduit pivotally disposed in the aperture to provide a passage in communication with the cavity, the L-shaped conduit being pivotable toward either of the first and second side surfaces of the door, the conductor extending through the L-shaped conduit.

2. The sensing edge of claim 1 wherein the at least one electrical conductor comprises first and second electrical conductors and the sensor comprises:

a first strip of flexible, electrically conductive material having a first face and a second face, the first face of the first strip of flexible, electrically conductive material being supported on the first inner surface of the sheath, the first strip of flexible, electrically conductive material being in electrical contact with a first electrical conductor;

a second strip of flexible, electrically conductive material having a first face and a second face, the first face of the second strip of flexible, electrically conductive material being supported on the second inner surfaces of the elongate outer sheath, the second face of the second strip of flexible, electrically conductive material facing the first strip of flexible, electrically conductive material, with a space being provided between the second faces of the first and second strips of flexible, electrically conductive material, the second strip of flexible, electrically conductive material being in electrical contact with the second electrical conductor.

3. The sensing edge of claim 1 further comprising an elongate base member for being secured to the leading edge surface of the door, the base member includes two female channel members, and two complementary male connector members are located on the first outer surface of the sheath, the male connector members on the sheath being releasably engageable with the female channel members of the base member, the L-shaped conduit being disposed between the two male connector members, the female channel members and the male connector members each including a notch located in proximity to the L-shaped conduit such that the L-shaped conduit can be pivotally oriented with the notches toward one of the first and second side surfaces of the door to allow connection to the at least one conductor.

4. A sensing edge for causing a door to open by actuating a device upon force being applied to the sensing edge, the door having a leading edge surface, a first side surface and a second side surface, the first and second side surfaces being oppositely disposed, the door being movably mounted, the sensing edge comprising:

an elongate base member for being secured to the leading edge surface of the door;

an elongate outer sheath having first and second ends and first and second opposing outer surfaces, the first outer surface being connected to the elongate base member;

first and second end members sealingly closing the first and second ends of the outer sheath to create an enclosed, sealed cavity;

an aperture defined through the first outer surface of the sheath in proximity to the first end of the sheath and fluid in communication with the cavity; and an L-shaped conduit pivotally disposed in the aperture to provide a passage in fluid communication with the cavity, the L-shaped conduit being pivotable toward either of the first and second side surfaces of the door, the L-shaped conduit being adapted for connection to a tube for actuation of the door opening device upon detection of an increase in pressure within the cavity as a result of an external force applied to the sheath.

5. The sensing edge of claim 4 further comprising a bushing located in the aperture and wherein the L-shaped conduit is pivotally disposed in the bushing, the bushing sealingly engaging an outer surface of the L-shaped conduit.

6. The sensing edge of claim 5 wherein the L-shaped conduit includes an enlarged portion which engages the bushing to retain the L-shaped conduit in position.

7. The sensing edge of claim 4 wherein the base member includes two female channel members, and two complementary male connector members are located on the first outer surface of the sheath, the male connector members on the sheath being releasably engageable with the female channel members of the base member, the L-shaped conduit being disposed between the two male connector members, the female channel members and the male connector members each including a notch located in proximity to the L-shaped conduit such that the L-shaped conduit can be pivotally oriented with the notches toward one of the first and second side surfaces of the door to allow connection to the tube.

8. The sensing edge of claim 4 further comprising a stop block located in the elongate outer sheath at each of the first and second ends.

9. A tool for assembling a sensing edge having an elongate outer sheath with a cavity defined therein, the cavity having a relaxed opening height defined between facing first and second inner surfaces thereof and an expanded opening height defined between the first and second inner surfaces as the assembly tool is inserted, and first and second strips of material being affixed to the first and second facing inner surfaces, the tool comprising:

an elongate body having first and second opposing outer surfaces, first and second ends, and first and second parallel longitudinal bores defined therethrough which are separated by an internal partition, the body having a height defined by the first and second opposing outer surfaces, the height being adapted to be less than the expanded opening height of the outer sheath;

a first end surface located at a first end of the first bore adapted to invert the first strip of material as it is drawn through the first bore and applied to the first inner surface;

a second end surface located at a first end of the second bore adapted to invert the second strip of material as it is drawn through the second bore and applied to the second inner surface, the second end surface being generally semi-cylindrical; and a support located adjacent to the first end of the body for attaching a pull device.

10. A sensing edge for causing a door to open by actuating a device upon force being applied to the sensing edge, the door having a leading edge surface, a first side surface and a second side surface, the first and second side surfaces being oppositely disposed, the door being movably mounted, the sensing edge comprising:

an elongate outer sheath having first and second ends, first and second opposing outer surfaces and a cavity with first and second facing inner surfaces, the first outer surface being adapted for connection to the leading edge of the door;

a first strip of resiliently compressible material having a first face and a second face, the first face being adhesively connected to one of the first and the second inner surfaces of the elongate outer sheath;

a first strip of flexible, electrically conductive material having a first face and a second face, the first face of the first strip of flexible, electrically conductive material being affixed to the second face of the first strip of resiliently compressible material;

a second strip of flexible, electrically conductive material having a first face and a second face, the first face of the second strip of flexible, electrically conductive material being supported on the other of the first and second inner surfaces of the elongate outer sheath, the second face of the second strip of flexible, electrically conductive material facing the second face of the first strip of flexible, electrically conductive material;

an open space between the entire second face of the first strip of flexible, electrically conductive material and the second face of the second strip of flexible, electrically conductive material, the first and second strips of flexible, electrically conductive material forming a sensor for detection of an external force applied to the sheath, whereby the first strip of resiliently compressible material is adapted to allow displacement of the first strip of flexible, electrically conductive material when the outer sheath is folded for shipping to prevent cracking of the first flexible, electrically conductive contact; and an aperture defined through the first outer and inner surfaces of the sheath, at least one electrical conductor electrically connected to each of the first and second strips of electrically conductive material for connection with a circuit for controlling the device for actuating the door to open and close, and an L-shaped conduit pivotally disposed in the aperture which provides a passage for the conductors, the L-shaped conduit being pivotable to orient the conductors toward either of the first and second side surfaces of the door.

* * * * *